US006510360B1

(12) United States Patent
Kaymer et al.

(10) Patent No.: US 6,510,360 B1
(45) Date of Patent: Jan. 21, 2003

(54) PRODUCING AN OBJECT-BASED DESIGN DESCRIPTION FILE FOR AN EMBROIDERY PATTERN FROM A VECTOR-BASED STITCH FILE

(75) Inventors: Andrew Bennett Kaymer, Loughton (GB); Martin Bysh, Leyton (GB)

(73) Assignee: Viking Sewing Machines AB, Huskvarna (SE)

( * ) Notice: Subject to any disclaimer, the term of this patent is extended or adjusted under 35 U.S.C. 154(b) by 0 days.

(21) Appl. No.: 09/654,154

(22) Filed: Sep. 1, 2000

(30) Foreign Application Priority Data

Sep. 7, 1999 (GB) ..... 9921013

(51) Int. Cl.[7] ..... G05B 19/18
(52) U.S. Cl. ..... 700/138; 112/475.19
(58) Field of Search ..... 700/136, 138, 700/137; 112/475.19, 102.5, 470.06

(56) References Cited

U.S. PATENT DOCUMENTS 5,474,000 A * 12/1995 Mizuno et al. ..... 112/102.5
5,559,711 A * 9/1996 Futamura et al. ..... 112/102.5 X
5,865,134 A 2/1999 Okuyama et al.
6,247,420 B1 * 6/2001 Chan et al. ..... 112/475.19

FOREIGN PATENT DOCUMENTS

EP 0 545 773 A1 6/1993
GB 2 334 264 8/1999

* cited by examiner

*Primary Examiner*—Peter Nerbun
(74) *Attorney, Agent, or Firm*—Pearne & Gordon LLP

(57) ABSTRACT

A computer is operated to produce an object-based design description file for an embroidery pattern from a vector-based stitch file describing the pattern as a sequence of stitches. The stitch file is analyzed to identify the stitch points qualifying as embroidery edge points at which the stitch direction substantially reverses. A list of these edge points is produced and the stitch file is further analyzed to identify groups of successive edge points in the list wherein the edge points of each group define an embroidery region of area filling type stitches. An object describing the respective embroidery region is then generated from the co-ordinate positions of edge points in a group.

25 Claims, 8 Drawing Sheets

PRODUCING AN OBJECT-BASED DESIGN DESCRIPTION FILE FOR AN EMBROIDERY PATTERN FROM A VECTOR-BASED STITCH FILE

BACKGROUND OF THE INVENTION

The present invention is concerned with methods of producing object-based design description files for embroidery patterns from vector-based stitch files describing the pattern as a sequence of stitches.

It is known to use vector-based stitch files for controlling computer controlled embroidery machines. Such stitch files contain a sequence of individual stitch instructions to control the embroidery machine to move the needle in a specified co-ordinate direction prior to performing the next needle insertion. Apart from vector data, each stitch instruction may also include additional data for instructing the embroidery machine, e.g. to perform a thread color change, a jump stitch or a trim.

It is also known to use object-based design description files for embroidery pattern definition. Such files define areas of the embroidery pattern as software objects, which can then be easily manipulated for creating a new embroidery design or modifying an existing design. Once a design has been created or modified as an object-based design description file, conversion software create a vector-based stitch file from the object-based file and the vector-based stitch file is used to control the embroidery machine.

Typically, the object-based file consists of information describing geometric objects such as columns, lines, opaque or transparent complex polygons bounded by lines or curves, etc. and instructions for producing a stitch file from these objects. The additional instructions may include stitch densities, fill patterns, thread colors and compensation factors.

There is sometimes a requirement to modify an embroidery pattern for which the only available data is in the form of the vector-based stitch file. Since such a stitch file may consist of many thousands of vectors (as many as there are stitches in the embroidery pattern), modifying the stitch file to change the pattern would require changes to a very large number of these vectors. There is therefore a recognized need for methods, particularly software methods, for analyzing an existing vector-based stitch file and producing therefrom an object-based design description file which can then be readily manipulated by means of design software to modify an existing design.

EP-A-0221163 describes a method of producing a modified embroidery pattern for an embroidery machine in which a stitch-by-stitch definition of the embroidery pattern is analyzed to determine the stitch types, the area, the stitch lengths and the stitch spacings for each sequence of stitches in the pattern. According to the specification, the design represented by the pattern is then modified and a new series of stitch-by-stitch commands is produced for controlling the embroidery machine. However, there are no details as to how the stitch-by-stitch data is analyzed to enable the design to be varied as required.

EP-A-0545773 discloses a method of producing a new embroidery design from an existing design pattern in which vector-based stitch data are analyzed to identify the angle at each stitch point. Stitch runs are then defined based on a commonality of the angles for stitches of a stitch run having a particular stitch type. Outline points defining an outline of the stitch run are then selected which can be subsequently edited to produce a new embroidery design pattern.

Essentially, the disclosed technique relies on identifying a sequence of stitches having a recognizable stitch type such as, satin stitching or tatami stitching (also known as fill stitching), and then identifying the outline of the region of the identified stitch type to allow subsequent editing of the overall pattern.

BRIEF SUMMARY OF THE INVENTION

The present invention provides a method of operating a computer to produce an object-based design description file for an embroidery pattern, from a vector-based stitch file describing the pattern as a sequence of stitches, the method comprising the steps of analyzing the stitch file to identify stitch points qualifying as embroidery edge points at which the stitch direction substantially reverses, producing a list of said identified edge points in the order of the corresponding stitch points in the stitch file, further analyzing the stitch file to identify groups of successive edge points in the list wherein the edge points of each group define a respective embroidery region containing only contiguous area filling type stitches, and generating from the co-ordinate positions of edge points in each identified group an object describing the respective embroidery region for the object-based design description file.

Whereas, the prior art '773 specification looks for regions of a particular stitch type, the above-identified invention defines potential objects for the object-based design file by looking for stitch points which qualify as edges in the stitch pattern, at which the stitch direction substantially reverses. In this way objects are created for the design description file without limiting these objects to regions of a single stitch type, such as SATIN or FILL. This has considerable advantages because a single embroidery region of an embroidery pattern may be filled with contiguous area filling type stitches of different types, for example the narrower parts of the region may contain SATIN stitching whereas the broader parts may contain FILL stitching. It is generally desirable for any one object of the object-based design description file to describe as large an area of the embroidery pattern as possible, it being understood that each object would normally be a region of consistent contiguous area filling stitches of the same color and bounded by a continuous outline. Preferably, the stitch points qualifying as embroidery edge points are identified by a) identifying as simple edge points stitch points for which the stitch angle between the stitches on either side of the respective stitch point is smaller than a precalculated threshold value, and b) finding pairs of consecutive stitch points forming a complex edge in which the aggregate stitch angle of the respective pair is less than a precalculated threshold value and identifying the stitch point of each said pair which has the smallest stitch angle as a complex edge point.

The aggregate stitch angle of the pair of stitch points forming a complex edge means the angle between the stitch line up to the first of the pair of stitch points forming the complex edge and the stitch line after the second of the pair. Thus the value of the aggregate angle of the pair of stitch points is the difference between 180° and the sum of the stitch angles at each of the stitch points of the pair forming the complex edge.

Many embroidery patterns may contain such complex edge points, as well as simple edge points involving a simple substantial reversal of direction of stitching at an individual stitch point. By comparison complex edge points require two successive stitch points to accommodate a substantial reversal of the stitch direction. In a complex edge, the stitch angle at each of the two stitch points forming the complex edge may be greater than the precalculated threshold value for a simple edge point, but nevertheless the aggregate stitch angle is small indicating a substantial reversal of the stitch direction overall.

Preferably, said groups of edge points are identified by defining an edge point in the list as an end of group point if the edge point meets at least one of a set of group termination conditions, said set of group termination conditions including at least one of:

a) the nearest following stitch point which forms at least part of an identified edge is not preceded in the sequence of stitches in the stitch file by a run stitch or another stitch point forming at least part of an identified edge;

(b) the edge angle of the edge point has the same sign as the immediately preceding edge point in the list, the edge angle being the angle described at the respective edge point between the line from the preceding edge point to the line to the next edge point;

(c) the edge length from the edge point to the next edge point in the list differs by more than a predetermined fraction from the preceding edge length from the edge point to the preceding edge point; or (d) the co-ordinates of the edge point are substantially the same as the co-ordinates of the next but one edge point in the list.

The functions of these conditions will be explained later herein.

In a preferred embodiment, the identified groups of edge points are categorized as FILL-type if less than a predetermined percentage less than 30% of the edge points in a respective said group correspond to consecutive stitches in the stitch file, and are otherwise categorized as SATIN-type. The group category as identified above is subsequently used for defining the object relating to the respective group.

A FILL-type group normally has a single consistent FILL angle which is determined by taking an average of the angles relative to a predetermined co-ordinate direction of the edge lines between consecutive edge points, over at least a central portion of the edge points of the group. Again the FILL angle determined in this way is used for defining the eventual object.

For a simple edge point, the line used for taking said average is the line through the simple edge point bisecting the line joining the respective preceding and following edge points.

Preferably, two identified groups of the same type which directly follow one another in the edge point list are merged to form a single group if the two groups meet predetermined merge criteria. This procedure allows regions of the embroidery pattern which could originally have been described by a single object, but which have been separated in the conversion process into two groups of edge points to be joined together again to form a single group, resulting in a single object in the final design description file.

In another aspect, the invention provides a method of operating a computer to produce an object-based design description file for an embroidery pattern, from a vector-based stitch file describing the pattern as a sequence of stitches, the method comprising the steps of:

analyzing the stitch file to identify groups of successive stitches in the stitch file which correspond to respective embroidery regions containing only contiguous area filling type stitches, defining outlines of the embroidery regions from the co-ordinate portions of selected stitch points from the respective groups of stitches, merging the outlines of embroidery regions corresponding to successive said groups in the stitch file, if the successive said groups meet predetermined merge criteria, to define merged outlines, and generating from said merged outlines and remaining unmerged outlines corresponding objects describing the respective embroidery regions for the object-based design description file.

Procedures for identifying objects from stitch files, such as described above, commonly divide areas of embroidery design which may originally have been represented by a single object into a number of fragmented objects. The merging method described above ameliorates this effect.

Preferably, said identified groups and their corresponding outlines are classified as SATIN-type comprising primarily SATIN stitches, or FILL-type comprising stitches forming a consistent fill angle between the mean stitch direction and a predetermined co-ordinate direction, and said predetermined merge criteria includes the requirement that the outlines to be merged must be of the same group.

Then, for FILL-type outlines the predetermined merge criteria may include at least one of:

a) the fill angles of the outlines to be merged must not deviate by more than a predetermined threshold;

b) the outlines to be merged must not overlap by more than a predetermined amount at the end of the first outline and the beginning of the second outline;

c) the fill density, being the number of stitches per unit length along a direction orthogonal to the mean stitch direction, of each of the outlines to be merged must not deviate by more than a predetermined amount; and d) the outlines to be merged must not be interrupted by a color change stitch.

Conveniently, each FILL-type outline is defined by a sequence of co-ordinate points around the outline, and the merge criteria further include that two consecutive connection points, forming a connection line, on each of outlines to be merged, must be identified for which connection conditions must be met including at least one of:

i) the angle between the connection lines must not exceed a predetermined value;

ii) the angle of each of the connection lines to said predetermined co-ordinate direction must not deviate from the respective fill angle by more than a predetermined amount;

iii) the length of the normal from the centre of one said connection line to the point of intersection with the other line must not exceed a predetermined value; and iv) the length of each connection line must be greater than a predetermined value.

Then, FILL-type outlines satisfying the merge criteria may be merged by inserting, between the identified connection points in the sequence of points of one outline, the sequence of co-ordinate points between the identified connection points of the other outline, to define a new sequence of co-ordinate points defining the merged outline.

Conveniently, the order of the sequence of co-ordinate points inserted is selected so that lines connecting the adjacent connection points in the new sequence do not intersect.

For SATIN-type outlines, the predetermined merge criteria may include at least one of:

a) there must be fewer than a predetermined number of stitches in the stitch file between outlines to be merged;

b) the outlines to be merged must not overlap by more than a predetermined proportion of the stitch points at the edges of the outlines;

c) if there are more than two stitches between outlines to be merged, the stitch densities of the outlines must not differ by more than a predetermined threshold; and d) the outlines to be merged must not be interrupted by a color change stitch.

Conveniently, each SATIN-type outline is defined by a first sequence of co-ordinate points down one side edge of the outline and a second sequence of co-ordinate points down the other side edge of the outline, and the merge criteria further include that, for first and second outlines to be merged, the last co-ordinate points of said first and second sequences of the first outline and the first co-ordinate points of said first and second sequences of the second outline form respective connection lines which must not differ in length by more than a predetermined fraction, and must not be spaced laterally by more than a predetermined distance.

Then, preferably, SATIN-type outlines satisfying the merge criteria are merged by adding said first sequences of the second outline to the end of a selected one of the sequences of the first outline and adding said second sequence of the second outline to the end of the other of the sequences of the first outline, so as to form first and second sequences of co-ordinate points defining the respective side edges of the merged outline.

The invention also provides computer apparatus programmed to produce an object-based design description file for an embroidery pattern from a vector-based stitch file describing the pattern as a sequence of stitches by processing the stitch file in accordance with the above-described method.

The invention still further contemplates a computer readable data carrier containing program instructions which control a computer to perform the above-described method.

Still further, the invention provides a computer readable data carrier containing an object-based design description file for an embroidery pattern, which file has been produced by the above-described method. The object-based design description file may of course have been further modified using embroidery design software operating on the object-based file.

The invention still further provides a computer readable data carrier containing a vector-based stitch file created from an object-based design description file for an embroidery pattern produced by the above-described method.

The invention still further provides a computer controlled embroidery machine controlled by a vector-based stitch file created from an object-based design description file for an embroidery pattern produced by the above-described method.

DETAILED DESCRIPTION OF THE INVENTION

Figure 1:
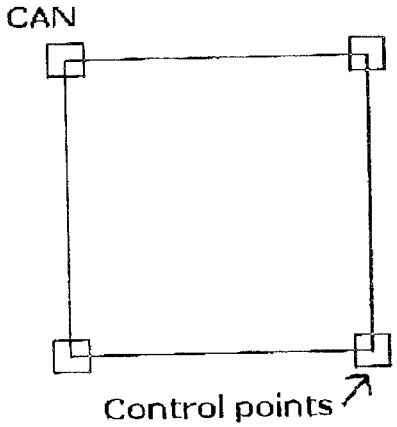
FIG. 1 illustrates a simple object in an object-based design description file for an embroidery pattern.
Figure 2:
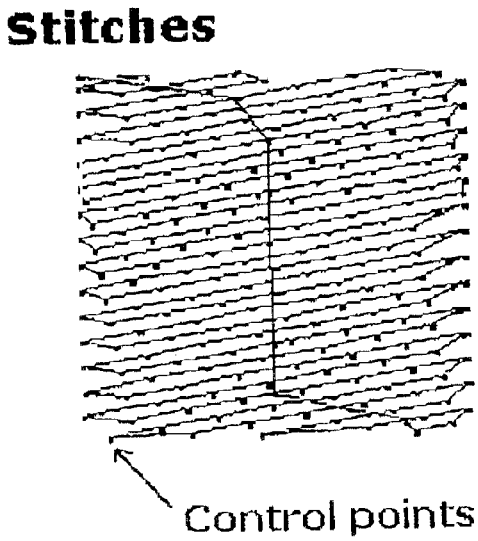
FIG. 2 illustrates the stitches of a stitch file for controlling an embroidery machine, which might be produced from the object of FIG. 1.

As mentioned previously, the underlying purpose of the present invention and its examples is to provide a method of processing stitch data in a vector-based stitch file describing an embroidery pattern with a view to regenerating an object-based design description file which can then be used for modifying the design. An object-based design description file can easily be created on design software in a fashion similar to that used by object-based drawing/painting image creation software. Further, an existing object-based design description file can easily be edited and modified to change an embroidery design, e.g. by inserting and moving control points on objects forming the design.

On the other hand it is a stitch file which is normally used for directly controlling a computer controlled embroidery machine.

When an embroidery pattern is described only by means of a stitch file, for example if the original object file has been lost or is unavailable, modifying a design described by such a stitch file is extremely difficult. The invention provides a convenient process for regenerating an object file from a stitch file so that an embroidery design can then more easily be modified.

The present example is concerned with creating an object-based design description file of the kind known as a CAN file. CAN files are files with the file extension "can" supplied or created for the digitizer used by Husqvarna Viking embroidery machines from Viking Sewing Machines AB. However the principles of the invention and also of detailed examples described herein could be used equally well for regenerating any other type of object-based design description file for embroidery patterns.

Brief Overview of the Process

The process begins by calculating the stitch angles at each of the stitch points represented by the stitch file. From the stitch angles an edge list is compiled. Edges are stitches that conform to what analysis has shown to be the most common form of stitches falling on the edges of outlines. These edges come in, broadly speaking, two varieties. The first, simple edges are identifiable as having a particular length to angle ratio, and the second, complex edges, consist of two stitches with the combined angle of approximately 180 degrees and a certain length to angle ratio. The length referred to here is the distance between edges.

Groups of these edges are then constructed, with groups being terminated by unclassifiable stitches (jumps, colors, trims etc), non-aberrant angle reversals, dramatic stitch edge length deviation, and any other stitches that are not classified as edges or ignored as straight lines between edges.

The groups are then categorized as satin or as fill, according to whether the majority of the edges in the group are of type simple or complex respectively. Some type dependent improvements are made to the groups and stitch density and angle information calculated.

Outlines are constructed from the co-ordinates of the edges and these are placed in lists structured differently according to whether the object is to be satin and fill. Where appropriate an attempt is made to join outlines together to improve the quality of the object. These outlines are then converted to CAN files, with all unclassifiable stitches being converted individually to their CAN file equivalents.

By comparison, the prior art method disclosed in EP 0545773 looks for groups of stitches that might be runs, groups that might be satin, groups of groups that might jointly comprise fill. The new method described herein looks for groups of edges irrespective of the types of these edges. It does not, for instance interrupt a group which consists largely of simple edges (of which satin is largely comprised) when a complex edge (of which fill is largely comprised) is met, despite the complex edge being dissimilar both in magnitude of angle and that it comprises two stitches. It interrupts a group only when a stitch occurs that would interrupt an object irrespective of the type of object (a color stitch for instance).

Thus, given the same stitches, the prior art method and the present new method would extract different objects. Further the quality of the objects (where quality is taken as topological proximity to the object from which the stitches were originally created) is markedly different, with the prior art method tending to break up fill areas into areas of fill and areas of satin.

Figure 3:
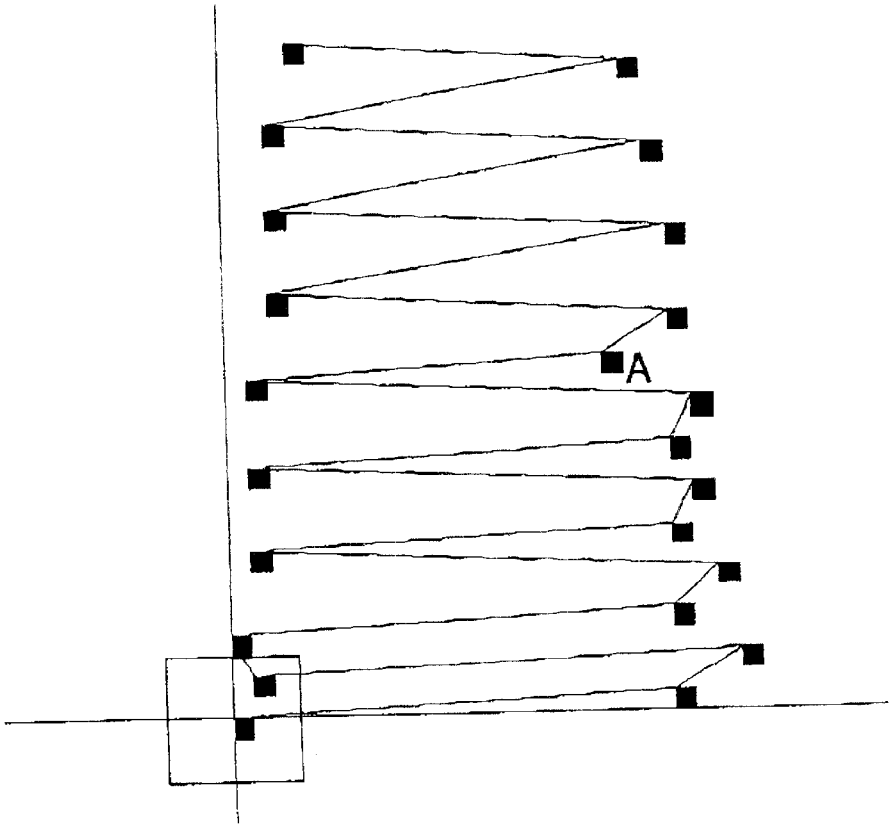
FIG. 3 illustrates a simple stitch file which could be processed by an embodiment of the present invention to find edge points.

Considering by way of example the stitches illustrated in FIG. 3, the present new method would make of the example file 16 edges, these 16 edges would be recognized as constituting a discrete group and would finally be turned into an outline for a single object. Using the prior art method this design would first be split into at least 6 groups. On the second pass of the prior art method the object would remain in two pieces as the first 8 stitches broken by the BIG angle at A would be classified as satin and the subsequent stitches would be classified as fill (tatami).

Detailed Description of Implementation

Stage 1: Preparation

To convert a stitch file to a CAN file, control points for CAN objects must be extracted from the outlines implicit in any stitch file. The first or preparatory stage of the process loads the stitch data into the conversion program and converts the stitch data from vectors into absolute co-ordinates, hereafter referred to individually as stitch points or stitches, or as a whole as the stitch list. The line between any two consecutive stitches A & B, where A occurs before B in the stitch list will be referred to as the stitch line at B, and the length of this line, as the stitch length of B.

Next, Embedded jump stitches are suppressed. A jump stitch is a stitch with an accompanying command value that instructs the machine to move along the vector but not to follow the movement with the usual insertion of the needle into the material. This jump stitch can then be trimmed from the design by the user. A jump stitch is used in this way to move between discrete parts of a design. Occasionally jump stitches are used to lengthen a stitch: a stitch has a maximum length, but if followed by one or more jumps (a movement without needle insertion) and then another stitch, a long stitch is created. A jump used like this is referred to as an embedded jump stitch. Such embedded jump stitches are removed restricting the significance of the jump stitch in all subsequent processes to its role in connecting discrete objects.

Figure 4:
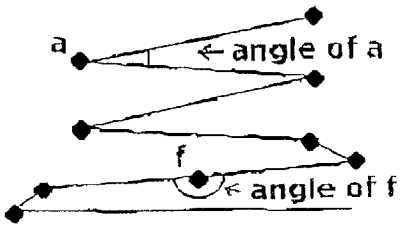
FIG. 4 illustrates the calculation of stitch angles for identifying edge points.

All zero stitches (stitches with x and y components equal to zero) are then removed from the stitch list as they provide no useful information. Finally, the internal angle each point makes with its surrounding two points (the stitch angle) is calculated and stored. The range of the angle calculated is −180 to 180 degrees indicating direction as well as magnitude. For example in FIG. 4, angle of stitch a may be positive whereas angle of stitch b is negative. Throughout all the processes described here where angles are calculated using three points, there are special case operations that apply to the first and last points in the list which do not have points either side. This usually consists of no more than storing default angles for these points.

Stage 2: Edge List Construction

Figure 5:
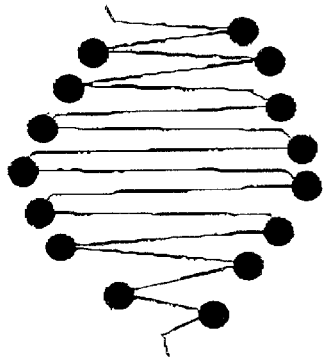
FIG. 5 illustrates the location of stitch points identified to qualify as edge points of part of an embroidery pattern.

Examination of a large number of stitch designs to determine the nature of a typical edge stitch yielded two possible forms for such a stitch, subsequently referred to as a simple edge and a complex edge. Complex edges consist of two consecutive stitches as seen in FIG. 5. All edges have the quality of reversing the stitch flow, and no edges are composed of jump stitches. The co-ordinates, angle and stitch list index of all edges identified, are added to the edge list.

Figure 6:
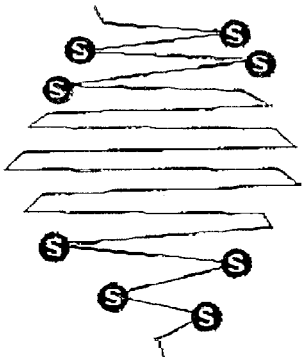
FIG. 6 identifies those of the edge points of FIG. 5 which qualify as simple edge points.

For a stitch to be designated a simple edge (marked S in FIG. 6) it must pass the simple threshold test by having a stitch angle below a certain size M. To obtain M, first calculate the length of the stitch, L. Then let M equal the angle value in the row below the smallest length larger than L, in Table 1. For stitches that qualify as a simple edge, the index number of the stitch in the stitch list and the co-ordinates of the stitch point are added in the next position in the edge list.

TABLE 1

Table of stitch length/angle thresholds for simple edges yielded from statistical analysis of stitch design:

| Length (mm) | Angle (degrees) |
|---|---|
| ∞ | 0 |
| 170 | 3 |
| 140 | 6 |
| 130 | 8 |
| 120 | 9 |
| 90 | 10 |
| 70 | 12 |
| 60 | 13 |
| 45 | 14 |
| 40 | 15 |
| 30 | 24 |
| 25 | 29 |
| 20 | 37 |
| 15 | 50 |
| 10 | 55 |
| 5 | 60 |
| 0 | 70 |

Figure 7:
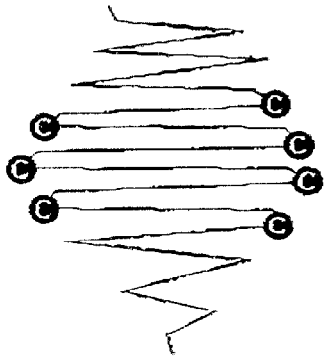
FIG. 7 illustrates those of the edge points of FIG. 5 which qualify as complex edge points.

For a stitch to be designated a complex edge point (marked C in FIG. 7) the sum of its angle and the angle of next stitch in the stitch list must approximate 180 degrees. The stitch list index and the co-ordinate of the stitch with the smallest stitch angle of the two is added to the edge list. Only one co-ordinate, angle and index can be added to identify the edge point of a respective edge; the stitch with the smallest angle is chosen as this will always be on the outside of the edge (FIG. 7). If the sum of the stitches in the complex edge deviate from 180 degrees by no more than 10 degrees then it is given the status free-ride.

Elsewhere in this specification, a complex edge is described as having an aggregate stitch angle, which, is the angle of the stitch line preceding the first stitch point relative to the stitch line after the second stitch point. Thus, the aggregate angle has a value equal to the difference between 180° and the sum of the stitch angles of the stitch points forming the complex edge.

If an edge of either type (comprising two stitch points for a complex edge) is not directly preceded by another edge of either type, or a run stitch, then it is further designated a new edge. A run stitch is a stitch whose internal angle approximates 180 degrees.

To summarize, at the completion of this stage an edge list has been extracted from the stitch list. The edge list consists of edge points of four types: simple, complex, new simple and new complex. For each edge point stored in the edge list there is also stored the angle, position, and index of the respective stitch. These edge points are provisional and will be used in the subsequent processes only if they survive a second test.

Once the edge list has been compiled, the angle of each edge point is recalculated using the edge point and an edge point either side of it in the edge list. This new angle is considered to be the real angle of the edge point as opposed to the stitch angle which was merely an approximation. Similarly, the edge length is calculated as the distance from the preceding edge point. If the edge point is a simple edge or new simple edge, it must pass the simple threshold test again using the new edge angle and the edge length rather than stitch length.

If it is a complex edge point or new complex edge point and does not have the status free-ride then it must pass a complex threshold test using a different set of thresholds as set out in Table 2. Thus, for each qualifying complex edge point, the recalculated edge angle must be less than the angle in Table 2 in the row below the smallest edge length larger than the actual edge length to the edge point. If an edge fails the test it is deleted from the edge list. If an edge is deleted, the next edge in the list is designated new.

Figure 8:
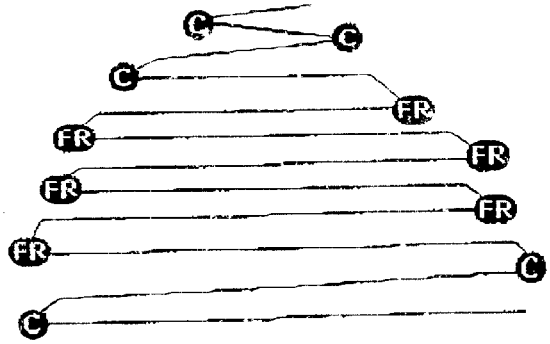
FIG. 8 illustrates a section of an embroidery design containing a number of complex edge points which fully qualify as edge points after a first round of testing.

All complex edge stitches with the status free-ride bypass the second angle test to avoid a pitfall of the thresholding. Some areas of stitches, such as illustrated in FIG. 8, can have rows so far apart that they would fail any threshold test sufficiently stringent to be useful. These areas of stitches are however, because they are not tightly packed, frequently very well formed. So the free-ride is added to allow these well formed complex-edge bounded areas to be found without disrupting the general usefulness of the edge detection process.

TABLE 2

Table of stitch length/angle thresholds for complex edges yielded from statistical analysis of stitch design

| Length (mm) | Angle (degrees) |
|---|---|
| ∞ | 0 |
| 500 | 6 |
| 110 | 8 |
| 90 | 10 |
| 45 | 13 |
| 40 | 15 |
| 30 | 19 |
| 25 | 29 |
| 20 | 37 |
| 15 | 50 |
| 10 | 55 |
| 5 | 60 |
| 0 | 70 |

Stage 3: Edge grouping

Strings of consecutive edge points, each string being terminated by an edge point which meets any one of a number of group termination conditions, are classified as groups and the index of the first and last edge point in each group are added to a group list. Groups can, and often do, consist of both complex and simple edge points.

The group termination conditions are as follows:

1) Sign reversal failure: Analysis of stitch design has shown an edge angle having the same sign as the preceding edge angle to be one of the most obvious and frequently occurring indicators of the completion of an area. However, it is occasionally the case that an aberrant angle sign similarity occurs which is not indicative of area completion but occurs instead because of mathematical rounding errors or inaccurate stitch creation routines. Therefore, when an edge meeting this termination condition is found, subsequent edges are checked for sign sequence conformity. If the string of edges directly following the failed edge conform to the sequence that would have existed has their not been a sign reversal failure then this reversal failure is deemed aberrant and ignored.

Figure 9:
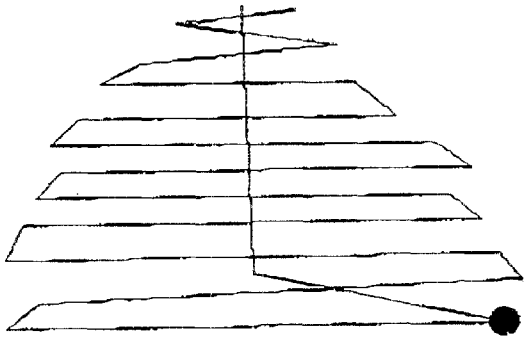
FIG. 9 illustrates an edge point which qualifies as an end of group edge point because the edge angle at the edge point has the same sign as that of the preceding edge point.
Figure 10:
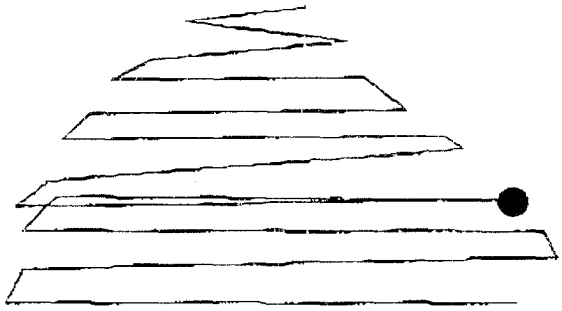
FIG. 10 illustrates another example of an edge point with an edge angle having the same sign as a preceding edge angle, but for which this does not indicate the end of a group of edge points.

FIG. 9 illustrates a legitimate instance of sign reversal failure, and FIG. 10 shows an aberrant sign reversal failure.

2) Significant edge length deviation: Edge length refers to the length of the edge line between an edge and the edge preceding it in the edge list. Because stitches in an area tend not to deviate dramatically in length from the preceding stitch length, edge lengths in a group should, likewise, not deviate by greater than a certain percentage of the preceding edge. There are occasional aberrant instances of such deviation occurring where no area completion has occurred. Such aberrations are dealt with in the outline connection stage.

3) Back and forthing: This termination condition removes a number of phenomena such as tie offs (stitches used to anchor the thread in the cloth after a jump stitch), that could otherwise be mistaken for legitimate groups. Tie offs, like legitimate stitch areas, are a series of stitches that go back and forth, reversing direction (angle sign), however, unlike most legitimate areas, tie offs move in only one dimension and cover the same distance as they move back and forth. Consequently the edge points of an edge at index β in the edge list will, if it is part of a tie off, or similar phenomenon, have the same co-ordinate component as the edge at indices β-2 and that at β4.

4) New edge encountered: If an edge which has been designated a new edge is encountered the group is complete and a new group is started with the new-edge. This takes care of many termination conditions which are effectively assessed at the stage of edge creation and lead to the designation "new" being applied to the edges.

The following additional information is compiled during this stage for later use:

a count of the number of edges with a zero angle in a group a ratio of the aggregated angles of edges at even indices with those at odd indices Stage 4: Group Weeding Some groups, despite passing stage 3 tests are not suitable for conversion to complex CAN objects and will instead be converted on a stitch by stitch basis to the simplest of CAN objects, the single stitch. The following criteria are used to weed out such groups, deleting them from the group list.

The zero angle (stage 3) count exceeds 40% of the number of edges in a group

There are fewer than 6 edges in group

The sequence simple edge—complex edge—simple edge with the simple edges having angles not exceeding 9 degrees, accounts for more than 30% of the group. This weeds out lattice pattern affects which bare a structural resemblance to a legitimate group, but for best results should remain a series of single stitches.

Stage 5: Group Categorization & Refinement (1)

The CAN objects which this process builds using the information extracted from the stitch file are provisionally categorized as follows: all edge groups consisting of fewer than 20% of edges with consecutive stitch indices are labeled FILL, all others are labeled SATIN. A number of other stitch types (Color change Stitches, Jump Stitches & Normal Stitches) are not classified at all: These stitches have CAN object equivalents. At the CAN object creation stage, equivalent CAN objects are generated and added to the CAN object list for all the stitches of these types which do not fall within edge objects.

At this point a small step is taken to improve the SATIN edge groups. Using the method outlined above, the first and last stitches of a satin area are frequently excluded from the edge group. The first point maybe excluded because it fails a threshold test, and the last may be excluded because of a significant edge length change, or angle which fails a threshold test. In either case the stitch in question would not have become an edge and so could form no part of an edge group. Having already identified a SATIN group it is possible to re-examine the stitches directly preceding and following this group, with less rigorous, context conditioned, inclusion criteria. The stitch length dependent angle of the simple threshold test is replaced with a 90 degree threshold test, and a slightly larger difference in stitch lengths between consecutive stitches is allowed. If the newly tested stitches pass these tests they become edges in the SATIN edge group in question.

Figure 11:
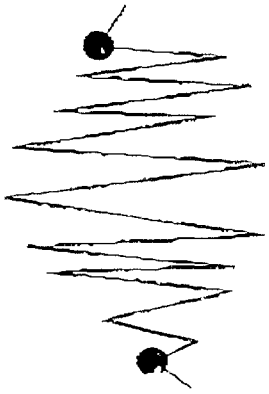
FIG. 11 illustrates the first and last stitch points of a SATIN-type group which might not be recognized as edge points of the group.

FIG. 11 illustrates a SATIN group with excluded first and last stitches.

Stage 6: Group Categorization & Refinement (2)

A second stage of categorization is performed after the extraction of the following information from the edge groups:

FILL Angle

Figure 12:
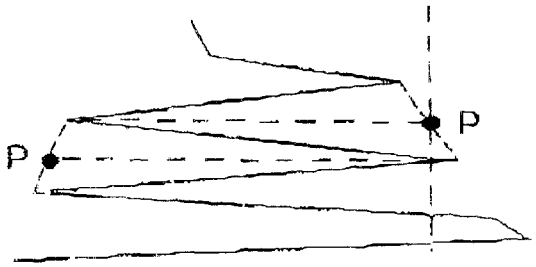
FIG. 12 illustrates the line used for estimating FILL angle of a group at simple edges of the group.

The average of the angles of all the edge lines in the middle-third block of edges of the FILL edge group is calculated. The angle is taken relative to the vertical. During this calculation, if an edge is a simple-edge, the angle taken is not that of the edge line relative to the vertical (the line made by consecutive edge points). Instead, for greater accuracy the line made by an edge and the point midway between the preceding and following edge is used, as illustrated in FIG. 12.

SATIN & FILL Density

Figure 13:
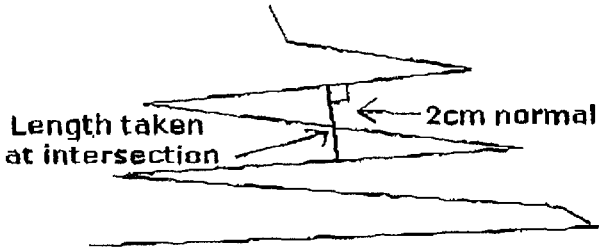
FIG. 13 illustrates the estimation of stitch density in a FILL or SATIN-type group.

The stitch density is the average distance between edge lines in a FILL or SATIN area. If stitch density is quite high, edge lines will tend to be very close together making it difficult to get an accurate reading of the distance between these lines. Therefore the first stage of density extraction is the scaling up of the edge group by M. Then, as illustrated in FIG. 13, the normal to the edge line is calculated in the direction of the next edge line, and scaled to 2 cm. The length of the normal taken from the centre of the edge line to its intersection with the next edge line is added to an accumulator, and a count is incremented. If at the end of this procedure the count is zero then this process has failed to calculate a valid density value. Otherwise the density value is the value of the accumulated distances scaled down by M, divided by the count, and further scaled slightly by an error compensation factor derived from analysis of the deviation of densities calculated using the above method from the original CAN object densities.

Failure of a FILL edge group to return a valid density value will result in the deletion of the group from the group list. The stitches which were part of this group will be converted to CAN objects one by one at CAN object creation time. This prevents certain phenomena, greatly resembling FILL, but actually of another type, erroneously generating FILL CAN objects.

Failure of a SATIN edge group to return a valid density value will result in the density value of the SATIN group defaulting to a preset value.

If the ratio of the aggregated angles of edges at even indices with those at odd indices, calculated at the end of Stage 3: is 2:1 or 1:2, and the group is FILL, then the group is recategorized SATIN-FILL. The CAN object created, will in fact be of type SATIN, but will include a pattern number, which when processed into stitches will create an area structurally similar to fill. A SATIN-FILL is dissimilar to FILL in that the edge lines do not follow a single angle. The angle of the edge lines follows the sweep of the outline (like SATIN). This tends to lead to the sort of angle ratio exploited here. This particular process is only occasionally effective, with the largest number of areas originally of type SATIN-FILL (in the original CAN file), becoming areas of type FILL in the CAN file generated using this process.

Stage 7: Outline Extraction & Refinement

Outlines are extracted from the edge groups and one outline is stored with each edge group. FILL and SATIN outlines are stored differently. An outline consists of co-ordinates only.

Figure 14:
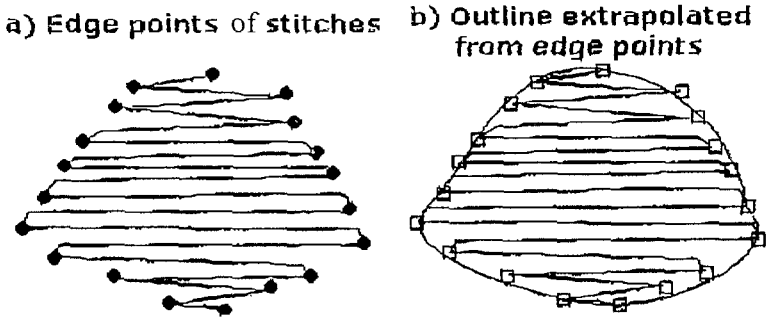
FIG. 14*a* illustrates a FILL-type group of edge points and FIG. 14*b* illustrates the outline interpolated from the edge points which may be used to create a FILL-type object.
Figure 15:
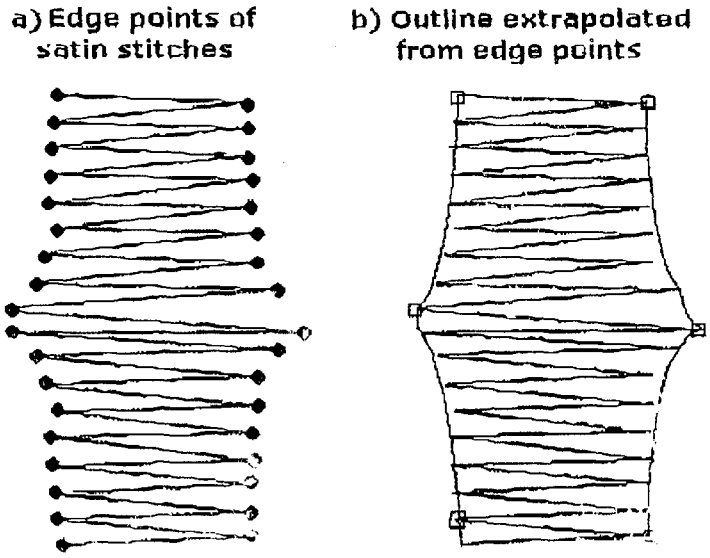
FIG. 15*a* illustrates the edge points of a SATIN-type group.
FIG. 15*b* illustrates the outline interpolated from the edge points of FIG. 15*a* which may be used to create a SATIN-type object.

Because the sequential stitches in a FILL or SATIN group go back and forth across the area, but the points in a CAN file FILL area are sequenced to go around the area, it is necessary to rearrange the points in the edge list as they are copied into the outline, with all odd points being copied first in order, followed by all even points in reverse order. The outline points, taken consecutively then define a complex polygon that is the same shape as the group. This is illustrated in FIG. 14.

The SATIN outline does not consist of all edge points. In general SATIN objects are less complex than FILL objects, and are defined not by a complex polygon but by two approximately parallel columns of point. Therefore instead of one outline being generated, two sides of an outline are created, and because it is not necessary to copy all edge points into the SATIN outline, every $n^{th}$ even point is copied into an array referred to as outlineL, and every $n^{th}$ odd point into an array referred to as outlineR, where n may be 8 for example.

Stage 8: Outline Connection

Figure 16A:
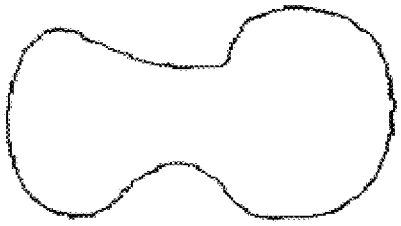
FIG. 16*a* illustrates an original object outline from a design description file and FIG. 16*b* illustrates the fragmented set of objects which may be created by analyzing the stitch file derived from the original object file.
Figure 16B:
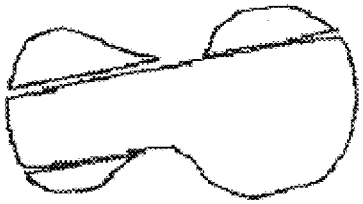
Figure 17A:
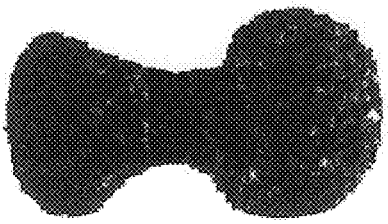
FIG. 17*a* illustrates the embroidery stitches generated from the original object file of FIG. 16*a* and FIG. 17*b* illustrates the stitches which may be derived from the fragmented object files of FIG. 16*b;*
Figure 17B:
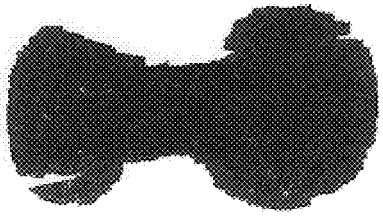

The edge groups that survived to Stage 7 will often be more numerous than the objects in the original CAN file, with each original object now consisting of several objects. This occurs very frequently, because the stitch groups when created from a CAN file (or equivalent) no longer accurately reflect the topology of the original CAN object. If a complex CAN shape is (as illustrated in FIG. 16*a* turned into stitches, each region is turned into a discrete region of stitches and these regions are joined by stitches that do not exhibit any internal regularities and so cannot be recognized as CAN segment connection stitches. FIG. 16*b* illustrates the discrete outlines into which the original complex shape may be fragmented. This fragmentation may also occur because of the inadequacy of the conversion process described here. When the new CAN file is turned into a stitch file, artifacts from the object fragmentation can negatively affect the quality of the stitch file, causing gaps where none should exist. Thus, whereas the stitch pattern produced from the original object is shown in FIG. 17*a*, the fragmented objects might produce the pattern shown in FIG. 17*b*.

Therefore, it is desirable to merge areas that could originally have formed a single area. To this end a series of criteria have been found which must be met by any two candidates for merging. Candidature is granted to any two edge groups of the same type, occupying consecutive positions in the edge list. These criteria are designed to connect only those areas that would have been part of one fill in the original CAN file.

For two FILL-type outlines to be merged all of the following criteria must be met:

- The FILL angle of the two outlines must not deviate by more than 5 degrees in either direction. Any two parts of one fill area in a CAN file will have the same FILL angle. However, the FILL angle that is returned in stage 5 is only an approximation, so successful candidates for merging need have similar, rather than the same FILL angle.
- The two outlines must not overlap. Outlines that are side by side, and were never part of the same object, are often excluded only by this criterion. A small amount of overlap of end of first outline with beginning of second outline may be permissible.
- The FILL density of the two outlines must not deviate by more than 2 mm. Any two parts of one fill area in a CAN file will have the same FILL density, however, the FILL density that is returned in stage 5 is only an approximation, so successful candidates for merging need have similar, rather than the same FILL density.
- The two outlines must not be interrupted by a color change stitch.
- Valid connection points must exist between the two fills. To guard against the reconnection of outlines at inappropriate points on those outlines, two consecutive points (a line) on each fill outline must be found that meet a number of criteria:
  - The angle between the lines must not exceed a pre-set maximum.
  - The deviation between the fill angle and the angle between each connection line and the vertical must not exceed a preset minimum.
  - The length of the normal from the centre of one line to its intersection with the other line must not exceeded a preset maximum.
  - The length of each line must be longer than a preset minimum.

Figure 18:
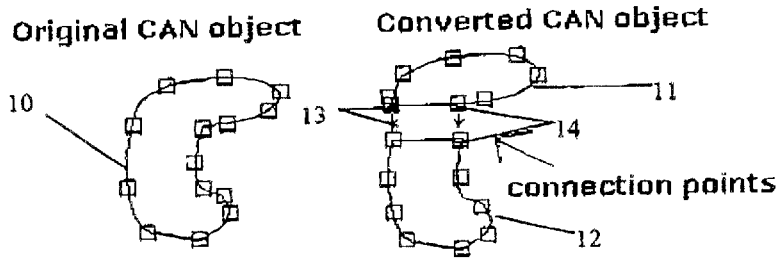
FIG. 18 illustrates good connection points which may be used for reconnecting or merging the fragmented objects generated by analysis of the stitch file to re-create a merged object corresponding to the original object.

This is illustrated in FIG. 18 which shows an original CAN object 10 and two separate outlines 11 and 12 converted from the stitch file. Good connection points for the outlines 11 and 12 are shown at 13 and 14.

Once two outlines qualify for connection, and valid connection points have been found, the connection can commence. Connection consists of inserting the edge points of the second outline into the list of edge points of the first outline. This may require a reversal in the ordering of the points in the second outline.

Figure 19:
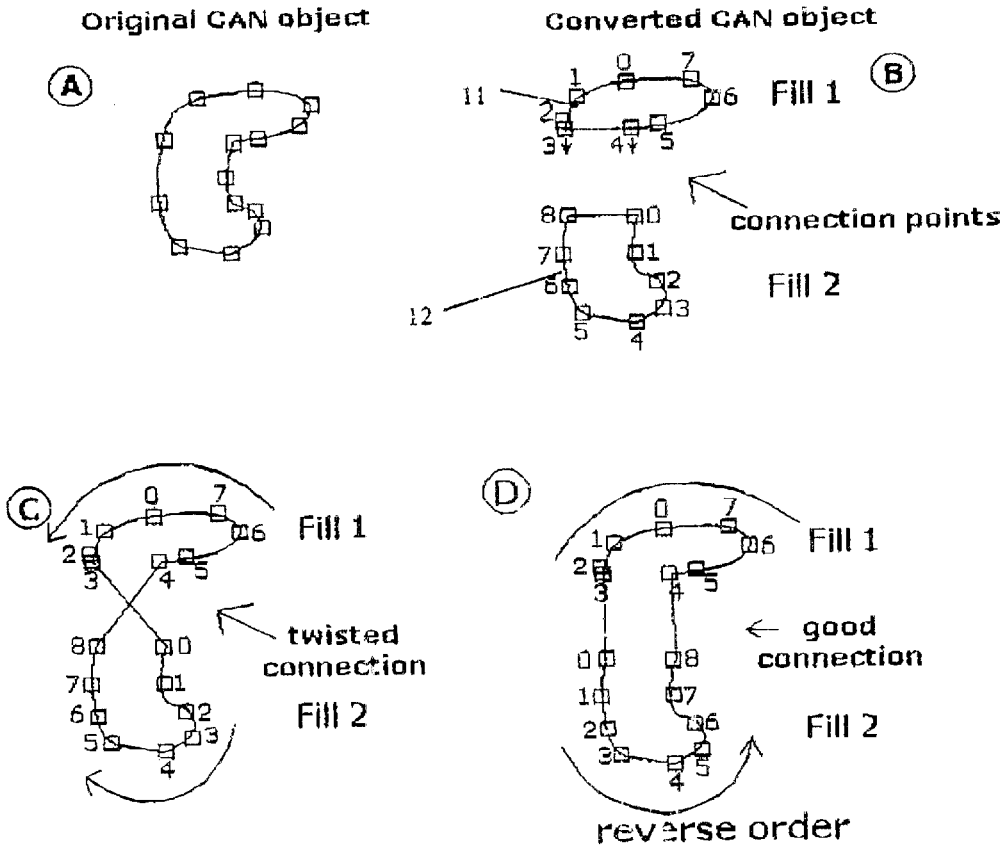
FIGS. 19*a, b, c* and *d* illustrate the avoidance of a twisted connection between two fragmented objects when merging to re-create the original object.

In the example FIG. 19 the best connection points have been determined at (3,4) on outline 11 and (8,0) on outline 12 (FIG. 19B). If the direction of the order of the points in the two outlines is not the same, when outline 12 is inserted it will cause a twist as shown in FIG. 19C. Twists are never intentionally created as part of a fill area, so it is important to connect 3 of outline 11 to 8 of outline 12, and 4 of outline 11 to 0 of outline 12. However, the points of outline 11 are simply inserted between the first insertion point and the second insertion point in outline 12 in their original index order a twist is formed. To avoid this it is necessary first to reverse the order of the points in outline 12 and then connect as shown in FIG. 19D.

For Two SATIN outlines to be merged all of the following criteria must be met:

- There must be fewer than a predetermined number of stitches between the two SATIN outlines. SATIN outlines which are good for reconnection are usually interrupted by only one or two unclassifiable stitches. If many stitches exist between SATIN outlines these areas are probably not suitable for reconnection.
- The two SATIN outlines must not overlap by more than 20% of the edge count. SATIN outlines that are side by side, and were never part of the same object, are often excluded only by this criterion. This is unlike the equivalent FILL reconnection criterion. For SATIN outlines only overlaps including more than 20% of the edges of the outlines disqualify the outlines for merging.
- If there are more than two stitches between the two satins then the density of the two satins must not deviate by more than 1 mm.

The two fills must not be interrupted by a color change stitch.

All edge points between the two SATIN outlines must have an angle of less than 90 degrees. This helps to ensure that the stitches between the two outlines, despite their original exclusion from the outlines, could be part of the same SATIN outline.

The two connection lines must not deviate in length by more than 50%.

A normal of 2 mm from one connection line must intercept the other connection line.

Figure 20:
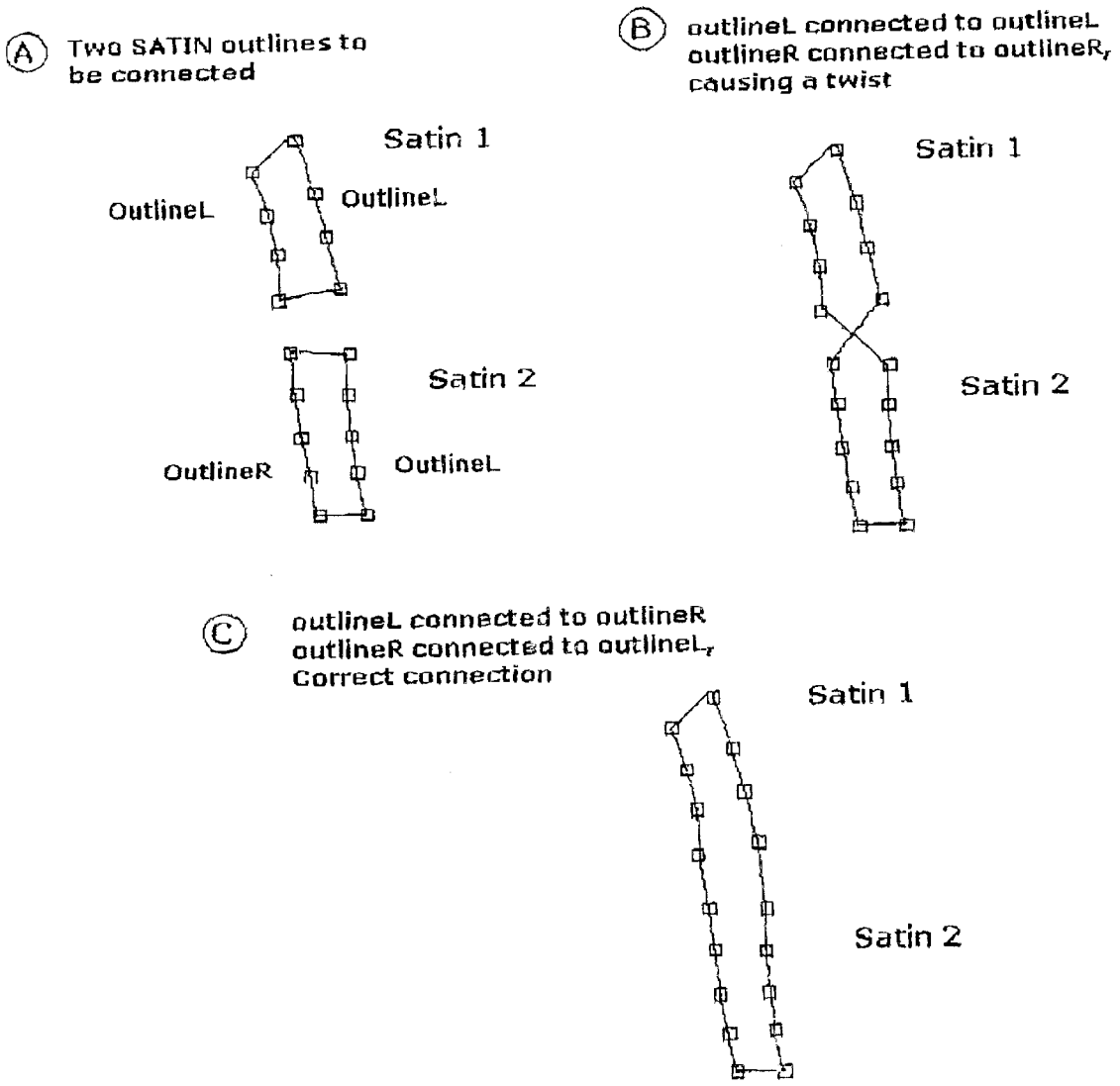
FIGS. 20*a, b,* and *c* illustrate avoidance of a twisted connection between SATIN fragmented objects.

Once two outlines qualify for connection, a further test is performed to prevent twisting (see FIG. 20). Two lines are drawn, one between the end point of the outlineL (see Stage 7 above) array of the first SATIN outlines of the two to be connected, and the start point of outlineL of the other SATIN outline. The second line is drawn between the outlineR points. If these two lines do not intersect each other then the connection process can continue by adding all points from outlineL in the second SATIN outline to the end of the outlineL array in the first SATIN outline, and all points from outlineR into the second SATIN outline to the end of the outlineR array in the first. If, however, the two lines do intersect as shown in FIG. 20B then instead of connecting the two outlineL arrays together and the two outlineRs, we connect the first outlineR with the second outlineL and the first outlineL with the second outlineR. The correctly merged SATIN outlines are then illustrated in FIG. 20C.

Although the group outline merging procedures are described above when applied to outlines derived from groups of edge points identified by the previously described method, these merging procedures can be used for merging stitch point outlines derived by other methods. For example stitch point outlines defining areas containing a common stitch type may be merged to create larger outlines using the above described merging procedures.

Stage 9: Outline Cleaning

After outline connection, some of the outlines are cleaned up: SATIN and SATIN FILL outlines are smoothed, gaps in SATIN loops are closed, FILL outlines will have spikes removed and the number of points in the outline will be reduced to only the points necessary to correctly describe the outline.

A spike in a FILL outline is a point jutting into an outline. This spike is identifiable as being further from the edge points either side of it in the edge list than they are from each other. When identified the edge point is translated to the point midway between the points either side of it.

The reduction of the number of points in an outline is desirable for the purposes of editing the CAN Object: an unnecessarily large number of point will require an unnecessarily large amount of editing to make even the smallest changes, as so many points will have to be moved to make these changes. Therefore in reducing the number of points (without changing the shape, and so ruining the design) we simplify the editing process. The point count reduction process is quite a simple one consisting of examining the angle made by each point in the outline with the point either side of it, if this angle deviates from 180 degrees by less than a preset maximum then this point is removed from the outline list.

Smoothing SATIN and SATIN FILL outlines is a slightly more complicated process, and is primarily desirable to compensate for drop stitches. Drop stitches are stitches that are made deliberately smaller than the surrounding stitches in a satin area, to prevent bunching on the inside of corners or tight curves.

Before smoothing commences one final stage of categorization is performed. There is a type of satin stitches, called feather, which differs from normal satin only in the irregularity of the lengths of the stitches of which it is comprised. This irregularity is a desired feature of feather and would be destroyed by the smoothing process. Consequently areas of feather must be identified at this stage and the smoothing process bypassed for these areas. The following test is used to find feather:

An array of the length of every second edge line in the satin area is constructed. The percentage that each length deviates from its succeeding neighbor is calculated. If more than 40% of the length deviations are greater than or equal to 40% then this satin is in fact feather and should not be smoothed.

Satin smoothing is performed on the edge points, not the outline points. Once this procedure has been completed the co-ordinates are copied from the edge points to their associated outline points, thus smoothing the outline via the edge list. The process steps through all edge points moving along one point at a time (effectively alternating between the left and right sides of the column). At each point a line L is imagined extending from that point to the point 4 (this number may change) points along in the edge list, which is of course on the same side of the column. If the edge line at each intervening edge point does not extend as far as L, extend it to L by translating the edge point onto L.

Figure 21:
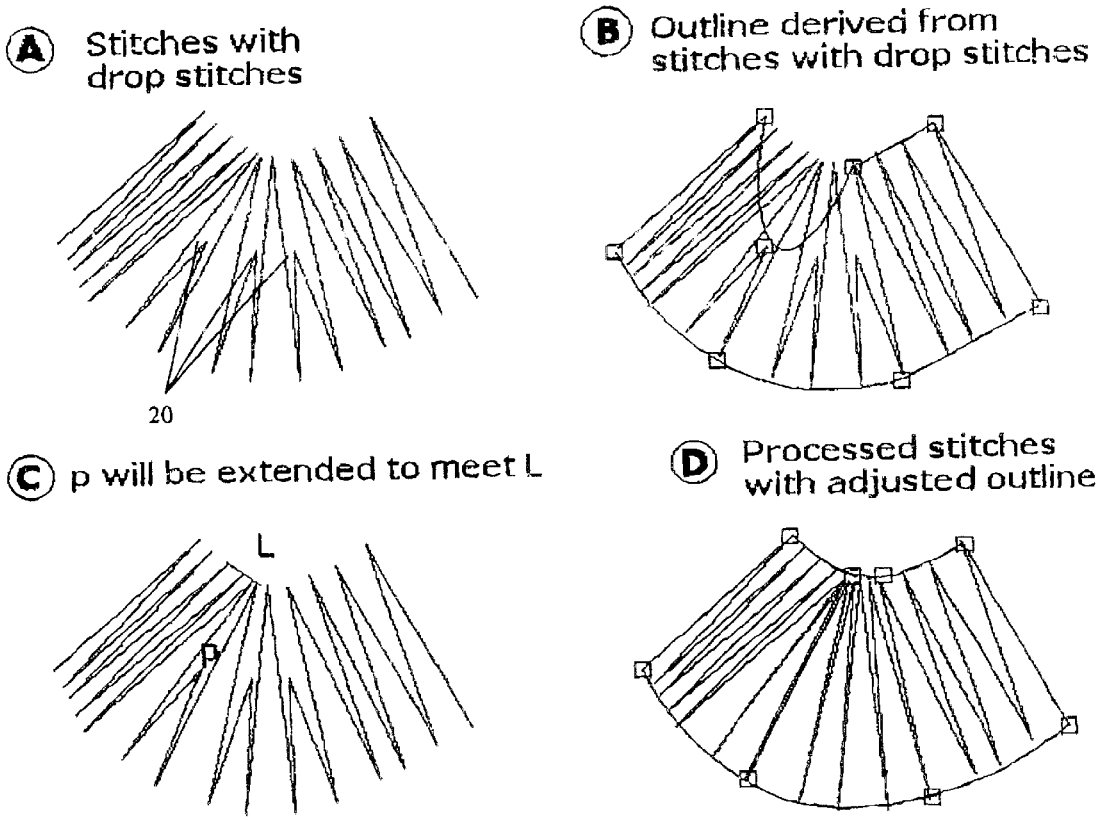
FIGS. 21*a, b, c* and *d* illustrate the process of cleaning the outlines of edge groups.

This is illustrated in FIG. 21, which shows in FIG. 21A a SATIN outline with drop stitches 20 forming SATIN outline points and a corresponding unsmoothed outline as in FIG. 21B. To smooth, drop stitches 20 are extended to the line L (FIG. 21 C), resulting in new outline points and a smoothed outline as in FIG. 21D.

Stage 10: CAN Object Creation

The final step in this process is to generate CAN objects from the outlines. Each outline is converted into the appropriate type of CAN object. Stitches in between outline objects are converted individually to CAN equivalents. These stitches include:

1) all normal stitches which were not included in outline objects after all previous processes.
2) color stitches
3) Trims
4) Jumps. Any jump smaller than 4 mm is converted to a normal stitch CAN object Between each object, should that object not end on the same co-ordinate as that on which the next object begins, is inserted a jump stitch, or, if the jump would be less than 4 mm a normal stitch.

All the points from each outline are used along with the extracted fill density and fill angle information to construct the CAN objects. The CAN file can then be edited, and saved for later editing.

Other Possibilities

The procedure described by way of example in Stages 1 to 7 above for obtaining outlines representing possible objects of design description file may be used without the outline merging or connecting procedure of Stage 8. Also principles of the outline connecting procedure may be employed for connecting outlines obtained from stitch files by procedures different from those described.

What is claimed is:

1. A method of operating a computer to produce an object-based design description file for an embroidery pattern, from a vector-based stitch file describing the pattern as a sequence of stitches, the method comprising the steps of analyzing the vector-based stitch file to identify stitch points qualifying as embroidery edge points at which the stitch direction substantially reverses;

producing a list of said identified edge points in the order of corresponding stitch points in the vector-based stitch file, further analyzing the vector-based stitch file to identify groups of successive edge points in the list of said identified edge points wherein the edge points of each group define a respective embroidery region containing only contiguous area filling type stitches, and generating from co-ordinate positions of edge points in each identified group an object describing the respective embroidery region for the object-based design description file.

2. A method as claimed in claim 1, wherein the stitch points qualifying as embroidery edge points are identified by a) identifying as sample edge points stitch points for which the stitch angle between the stitches on either side of the respective stitch point is smaller than a precalculated threshold value, and b) finding pairs of consecutive stitch points forming a complex edge in which the aggregate stitch angle of the respective pair is less than a precalculated threshold value and identifying the stitch point of each said pair which has the smaller stitch angle as a complex edge point.

3. A method as claimed in claim 2, wherein said groups of edge points are identified by defining an edge point in the list as an end of group edge point if the edge point meets at least one of a set of group termination conditions, said set of group termination conditions including at least one of:

a) the nearest following stitch point which forms at least part of an identified edge is not preceded in the sequence of stitches in the stitch file by a run stitch or another stitch point forming at least part of an identified edge;

b) the edge angle of the edge point has the same sign as the immediately preceding edge point in the list, the edge angle being the angle described at the respective edge point from the line to the preceding edge point to the line to the next edge point;

c) the edge length from the edge point to the next edge point in the list differs by more than a predetermined fraction from the preceding edge length from the edge point to the preceding edge point; or d) the co-ordinates of the edge point are substantially the same as the co-ordinates of the next but one edge point in the list.

4. A method as claimed in claim 3, wherein the identified groups of edge points are categorized as FILL-type if less than a predetermined percentage less than 30% of the edge points in a respective said group correspond to consecutive stitches in the stitch file, and are otherwise categorized as SATIN-type.

5. A method as claimed in claim 4, wherein the FILL angle of each FILL-type group is determined by taking an average of the angles relative to a predetermined co-ordinate direction of the edge lines between consecutive edge points, over at least a central portion of the edge points of the group.

6. A method as claimed in claim 5, when dependent on claim 2, wherein, for a simple edge point, the line used for taking said average is the line through the simple edge point bisecting the line joining the respective preceding and following edge points.

7. A method as claimed in claim 4, wherein two identified groups of similar type which directly follow one another in the edge point list are merged to form a single group if the two groups meet predetermined merge criteria.

8. A method of operating a computer to produce an object-based design description file for an embroidery pattern, from a vector-based stitch file describing the pattern as a sequence of stitches, the method comprising the steps of analyzing the stitch file to identify groups of successive stitches in the stitch file which correspond to respective embroidery regions containing only contiguous area filling type stitches, defining outlines of the embroidery regions from co-ordinate portions of selected stitch points from the respective groups of stitches, merging the outlines of embroidery regions corresponding to successive said groups in the stitch file, if the successive said groups meet predetermined merge criteria, to define merged outlines, and generating from said merged outlines and remaining unmerged outlines corresponding objects describing the respective embroidery regions for the object-based design description file.

9. A method as claimed in claim 8, wherein said identified groups and their corresponding outlines are classified as SATIN-type comprising primarily SATIN stitches, or FILL-type comprising stitches forming a consistent fill angle between the mean stitch direction and a predetermined co-ordinate direction, and said predetermined merge criteria includes the requirement that the outlines to be merged must be of the same group.

10. A method as claimed in claim 9, wherein for FILL-type outlines the predetermined merge criteria include at least one of:

a) the fill angles of the outlines to be merged must not deviate by more than a predetermined threshold;

b) the outlines to be merged must not overlap by more than a predetermined amount at the end of the first outline and the beginning of the second outline;

c) the fill density, being the number of stitches per unit length along a direction orthogonal to the mean stitch direction, of each of the outlines to be merged must not deviate by more than a predetermined amount; and d) the outlines to be merged must not be interrupted by a color change stitch.

11. A method as claimed in claim 10, wherein each FILL-type outline is defined by a sequence of co-ordinate points around the outline, and the merge criteria further include that two consecutive connection points, forming a connection line, on each of outlines to be merged, must be identified for which connection conditions must be met including at least one of:

i) the angle between the connection lines must not exceed a predetermined value;

ii) the angle of each of the connection lines to said predetermined co-ordinate direction must not deviate from the respective fill angle by more than a predetermined amount;

iii) the length of the normal from the centre of one said connection line to the point of intersection with the other line must not exceed a predetermined value; and iv) the length of each connection line must be greater than a predetermined value.

12. A method as claimed in claim 11, wherein FILL-type outlines satisfying the merge criteria are merged by inserting, between the identified connection points in the sequence of points of one outline, the sequence of co-ordinate points between the identified connection points of the other outline, to define a new sequence of co-ordinate points defining the merged outline.

13. A method as claimed in claim 12, wherein the order of the sequence of co-ordinate points inserted is selected so that lines connecting the adjacent connection points in the new sequence do not intersect.

14. A method as claimed in claim 9, wherein for SATIN-type outlines the predetermined merge criteria include at least one of:

a) there must be fewer than a predetermined number of stitches in the stitch file between outlines to be merged;

b) the outlines to be merged must not overlap by more than a predetermined proportion of the stitch points at the edges of the outlines;

c) if there are more than two stitches between outlines to be merged, the stitch densities of the outlines must not differ by more than a predetermined threshold; and d) the outlines to be merged must not be interrupted by a color change stitch.

15. A method as claimed in claim 14, wherein each SATIN-type outline is defined by a first sequence of co-ordinate points down one side edge of the outline and a second sequence of co-ordinate points down the other side edge of the outline, and the merge criteria further include that, for first and second outlines to be merged, the last co-ordinate points of said first and second sequences of the first outline and the first co-ordinate points of said first and second sequences of the second outline form respective connection lines which must not differ in length by more than a predetermined fraction, and must not be spaced laterally by more than a predetermined distance.

16. A method as claimed in claim 15, wherein SATIN-type outlines satisfying the merge criteria are merged by adding said first sequences of the second outline to the end of a selected one of the sequences of the first outline and adding said second sequence of the second outline to the end of the other of the sequences of the first outline, so as to form first and second sequences of co-ordinate points defining the respective side edges of the merged outline.

17. Computer apparatus programmed to produce an object-based design description file for an embroidery pattern from a vector-based stitch file denoting the pattern as a sequence of stitches, by processing the stitch file in accordance with the method of any one of claims 1–16.

18. A computer readable data carrier containing program instructions which control a computer to perform the method claimed in any one of claims 1 to 16.

19. A computer readable data carrier containing an object-based design description file for an embroidery pattern, which file has been produced by method of any one of claims 1 to 16.

20. A computer readable data carrier containing an object-based design description file for an embroidery pattern, in accordance with claim 19, wherein the object-based design description file has been modified using an embroidery design program operating on said object-based design description file.

21. A computer readable data carrier containing a vector-based stitch file created from an object-based design description file for an embroidery pattern produced by the method of any one of claims 1 to 16.

22. A method as claimed in claim 1, wherein the identified groups of edge points are categorized as FILL-type if less than a predetermined percentage less than 30% of the edge points in a respective said group correspond to consecutive stitches in the stitch file, and are otherwise categorized as SATIN-type.

23. A method as claimed in claim 2, wherein the identified groups of edge points are categorized as FILL-type if less than a predetermined percentage less than 30% of the edge points in a respective said group correspond to consecutive stitches in the stitch file, and are otherwise categorized as SATIN-type.

24. A method as claimed in claim 5, wherein two identified groups of similar type which directly follow one another in the edge point list are merged to form a single group if the two groups meet predetermined merge criteria.

25. A method as claimed in claim 6, wherein two identified groups of similar type which directly follow one another in the edge point list are merged to form a single group if the two groups meet predetermined merge criteria.

* * * * *

UNITED STATES PATENT AND TRADEMARK OFFICE

CERTIFICATE OF CORRECTION

PATENT NO. : 6,510,360 B1 
DATED : January 21, 2003
INVENTOR(S) : Andrew Bennett Kaymer et al.

It is certified that error appears in the above-identified patent and that said Letters Patent is hereby corrected as shown below:

Title page,
Item [30], Foreign Application Priority Data, please delete "Sep. 7, 1999", and insert therefor -- Sep. 6, 1999 --.

Item [56], References Cited, FOREIGN PATENT DOCUMENTS, please insert the following reference:

-- WO 86/06423 11/1986 --.

Column 10,
Line 61, please delete "has their", and insert therefor -- had their --.

Column 20,
Line 3, after 1-16, please insert -- and 22 - 25 --.
Line 6, after 1 to 16, please insert -- , and 22 to 25 --.
Line 10, after 1 to 16, please insert -- , and 22 to 25 --.
Line 20, after 1 to 16, please insert -- , and 22 to 25 --.

Signed and Sealed this

Eighth Day of July, 2003

JAMES E. ROGAN
*Director of the United States Patent and Trademark Office*